US011401712B2

(12) United States Patent
Fu et al.

(10) Patent No.: US 11,401,712 B2
(45) Date of Patent: Aug. 2, 2022

(54) ENERGY-CONSUMING CONNECTING DEVICE FOR PREFABRICATED ASSEMBLED WALL

(71) Applicant: DALIAN UNIVERSITY OF TECHNOLOGY, Liaoning (CN)

(72) Inventors: Xing Fu, Liaoning (CN); Hongnan Li, Liaoning (CN); Gang Li, Liaoning (CN); Xu Xu, Liaoning (CN); Wenlong Du, Liaoning (CN); Zhiqian Dong, Liaoning (CN)

(73) Assignee: DALIAN UNIVERSITY OF TECHNOLOGY, Liaoning (CN)

( * ) Notice: Subject to any disclaimer, the term of this patent is extended or adjusted under 35 U.S.C. 154(b) by 0 days.

(21) Appl. No.: 17/293,341

(22) PCT Filed: Jul. 16, 2020

(86) PCT No.: PCT/CN2020/102418

§ 371 (c)(1),
(2) Date: May 12, 2021

(87) PCT Pub. No.: WO2022/011644

PCT Pub. Date: Jan. 20, 2022

(65) Prior Publication Data

US 2022/0090376 A1 Mar. 24, 2022

(51) Int. Cl.
*E04B 1/98* (2006.01)
*E04B 1/61* (2006.01)

(52) U.S. Cl.
CPC ..... *E04B 1/98* (2013.01); *E04B 1/54* (2013.01); *E04B 1/61* (2013.01)

(58) Field of Classification Search
CPC ..... E04H 9/029; E04H 9/027; E04H 9/00; E04B 1/98; E04B 1/54; E04B 1/61
See application file for complete search history.

(56) References Cited

U.S. PATENT DOCUMENTS 5,147,018 A * 9/1992 Kobori ..... E04B 1/98 188/300

FOREIGN PATENT DOCUMENTS

CN 103147529 A 6/2013
CN 205742594 U 11/2016
(Continued)

*Primary Examiner* — Patrick J Maestri
(74) *Attorney, Agent, or Firm* — Muncy, Geissler, Olds & Lowe, P.C.

(57) ABSTRACT

The present invention belongs to the technical field of energy consumption and vibration reduction of assembled building structures, and provides an energy-consuming connecting device for a prefabricated assembled wall. The present invention provides a normal connection function between walls, and also has the functions of energy consumption and vibration reduction. A used viscoelastic material can provide energy consumption and weaken the cold and hot bridge effect, which is beneficial to building thermal insulation. Meanwhile, the energy-consuming connecting device for the prefabricated assembled wall can be connected with a prefabricated wall in advance, which can be carried out at the same time as the wall is inserted during construction, thereby effectively increasing the construction efficiency. Through the design of clamping groove devices, the wall can be connected firmly and reliably while generating displacement and consuming energy. A multi-segment fixing plate is used to replace full-length arrangement to save the steel.

3 Claims, 3 Drawing Sheets

(56) References Cited

FOREIGN PATENT DOCUMENTS

| | | | |
|---|---|---|---|
| CN | 107190880 | A | 9/2017 |
| CN | 207453146 | U | 6/2018 |
| CN | 108678508 | A | 10/2018 |
| CN | 109667354 | A | 4/2019 |
| CN | 110820977 | A | 2/2020 |
| JP | H0666044 | A | 3/1994 |

* cited by examiner

ENERGY-CONSUMING CONNECTING DEVICE FOR PREFABRICATED ASSEMBLED WALL

TECHNICAL FIELD

The present invention belongs to the technical field of energy consumption and vibration reduction of assembled building structures, and particularly relates to an energy-consuming connecting device for a prefabricated assembled wall.

BACKGROUND

In recent years, due to the advantages of rapid construction, high industrialization degree and saving of manpower and material resources, assembled buildings have emerged in the market. In the installation process of the traditional prefabricated assembled walls, two walls are longitudinally connected by filling sleeves, and the mechanical properties are little different from those of cast-in-situ walls. However, the two walls are generally welded by embedded parts in the transverse direction, and are weak in the connection stiffness. Compared with the cast-in-situ walls, this type of assembled wall has poor integrity. It is easy to generate a large joint seam at the transverse junction of the two walls. At present, it is common practice to simply fill the wall seam directly and then seal the surface. However, this practice is easy to form cold and hot bridges to weaken the thermal insulation effect of the buildings, and is insufficient in energy consumption and vibration reduction capacities so that the walls are very easy to crack under transverse vibration. Therefore, the development of a wall connecting device with reasonable design and obvious energy-consuming effect will be beneficial to improve safety, stability and vibration resistance of the assembled buildings.

SUMMARY

The purpose of the present invention is to invent a prefabricated assembled wall connecting device which has reasonable design and obvious energy consumption effect.

The technical solution of the present invention is as follows:

An energy-consuming connecting device for a prefabricated assembled wall is of a symmetrical structure and mainly composed of a wrapping steel plate 1, a viscoelastic material 2, a grooved steel plate 3, a first fixing plate 4, a second fixing plate 5, a spring 6, a plate-shaped dowel 7 and an H-shaped steel column 8.

The wrapping steel plate 1 is of a "J"-like structure; the top of a long edge of the wrapping steel plate is fixedly connected with one side of a wall 9, and a gap exists between a short edge and the other side of the wall 9; and the wrapping steel plate 1 and the wall 9 are fixedly connected lengthwise.

The viscoelastic material 2 is bonded to the inner wall of the wrapping steel plate 1 and the inner wall of the second fixing plate 5.

The long edge of the grooved steel plate 3 is bonded with the viscoelastic material 2, and two short edges of the grooved steel plate respectively have gaps from the wall 9 and the inner wall of the short edge of the wrapping steel plate 1; and a clamping groove is formed on the grooved steel plate 3 in alignment with the plate-shaped dowel 7.

One end of the first fixing plate 4 is fixedly connected with the wall 9, and the other end is fixedly connected with the H-shaped steel column 8; and the fixing plate 4 is not a full-length plate, but a segmented plate.

One end of the second fixing plate 5 is fixed on the wall 9, and the other end is opposite to the short edge of the wrapping steel plate 1; and the second fixing plate 5 is connected with a short edge of the grooved steel plate 3 through the viscoelastic material 2, and is fixedly connected with the wall 9 lengthwise.

Clamping grooves are formed on the H-shaped steel column 8 at the plate-shaped dowel 7, wherein the positions of the clamping grooves on a flange of a single side are mutually staggered, and the clamping grooves on flanges of both sides are symmetrically arranged; and two flanges of the H-shaped steel column 8 are clamped into the grooved steel plate 3.

The plate-shaped dowel 7 is connected with the spring 6 and the spring 6 is fixed with the H-shaped steel column 8, wherein both sides of the plate-shaped dowel 7 are respectively clamped into the grooved steel plate 3 and the clamping grooves formed on the H-shaped steel column 8.

The wrapping steel plate 1, the viscoelastic material 2, the grooved steel plate 3 and the second fixing plate 5 are prefabricated in advance with one side of the wall 9, and the first fixing plate 4 and the H-shaped steel column 8 are prefabricated in advance with the other side of the wall 9.

The viscoelastic material 2 is selected from rubber.

In the energy-consuming connecting device for the prefabricated assembled wall, two assembled walls on which the energy-consuming devices are installed need to be accurately docked and inserted.

The flange thickness of the H-shaped steel column 8 satisfies the depth requirement of the clamping grooves at the flanges.

The present invention has the working principle that:

The two assembled walls can generate horizontal and vertical relative displacement under vibration and drive the H-shaped steel column and the wrapping steel plate to generate mutual dislocation, so that the grooved steel plate and the viscoelastic material generate relative shear displacement and the viscoelastic material dissipates part of vibration kinetic energy, thereby reducing vibration displacement. Meanwhile, the plate-shaped dowel is clamped between the grooved steel plate and the H-shaped steel column. When the two walls are vertically dislocated, the plate-shaped dowel is sheared to consume energy, so as to suppress the vertical dislocation displacement of the walls.

The present invention has the following beneficial effects:

1. The energy-consuming connecting device for the prefabricated assembled wall in the present invention can effectively improve the integrity of the prefabricated wall, and greatly reduce the horizontal and vertical relative displacement under vibration to ensure the structural safety.
2. In the energy-consuming connecting device for the prefabricated assembled wall in the present invention, the viscoelastic material can weaken the cold and hot bridge effect while providing energy consumption, which is beneficial to building thermal insulation.
3. The energy-consuming connecting device for the prefabricated assembled wall in the present invention can be connected with the prefabricated wall in advance, which can be carried out at the same time as the wall is inserted during construction, thereby effectively increasing the construction efficiency.
4. In the energy-consuming connecting device for the prefabricated assembled wall in the present invention, to consume the vibration energy of the structure, flexible connection is adopted, and to ensure more firmness, the clamping groove devices are designed so that the wall is connected firmly and reliably while generating displacement and consuming energy.

5. The energy-consuming connecting device for the prefabricated assembled wall in the present invention has reasonable design, simple structure, convenient maintenance, convenient production and installation and good application prospects.

Figure 1:
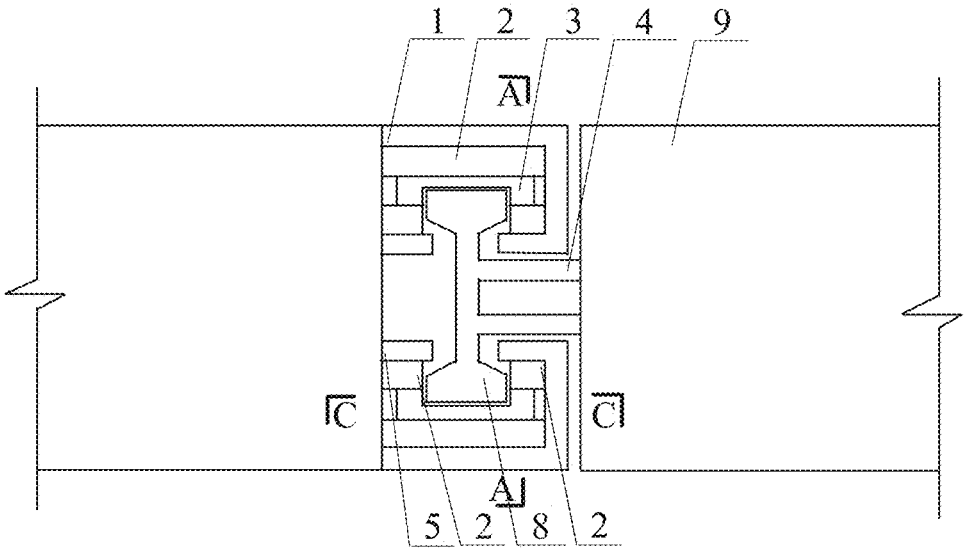
FIG. 1 is a planar diagram of an energy-consuming connecting device for a prefabricated assembled wall provided in an embodiment of the present invention.

In the drawings: 1 wrapping steel plate; 2 viscoelastic material; 3 grooved steel plate; 4 first fixing plate; 5 second fixing plate; 6 spring; 7 plate-shaped dowel; 8 H-shaped steel column; 9 assembled wall.

DETAILED DESCRIPTION

To make the purpose, features and advantages of the present invention more clear and legible, the technical solution in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

Figure 2:
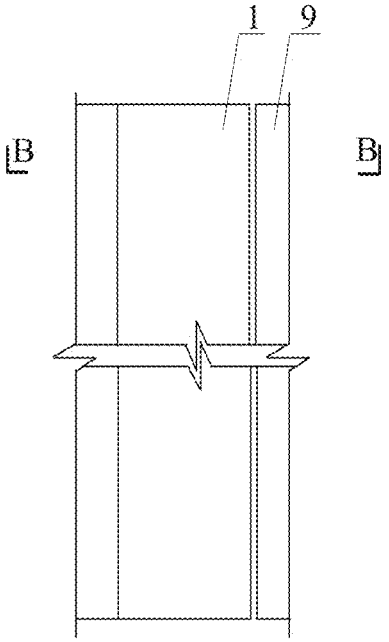
FIG. 2 is a vertical view of an energy-consuming connecting device for a prefabricated assembled wall provided in an embodiment of the present invention.
Figure 3:
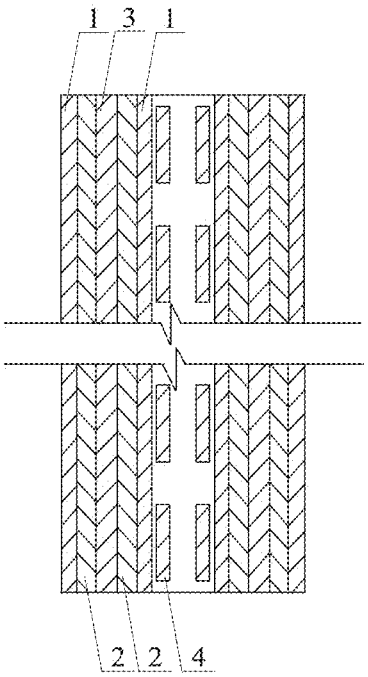
FIG. 3 is an A-A sectional view of an energy-consuming connecting device for a prefabricated assembled wall provided in an embodiment of the present invention.
Figure 4:
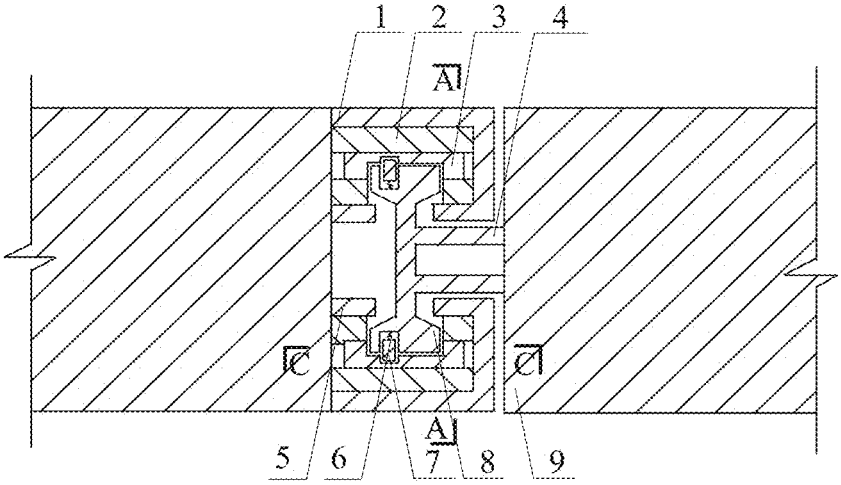
FIG. 4 is a B-B sectional view of an energy-consuming connecting device for a prefabricated assembled wall provided in an embodiment of the present invention.
Figure 5:
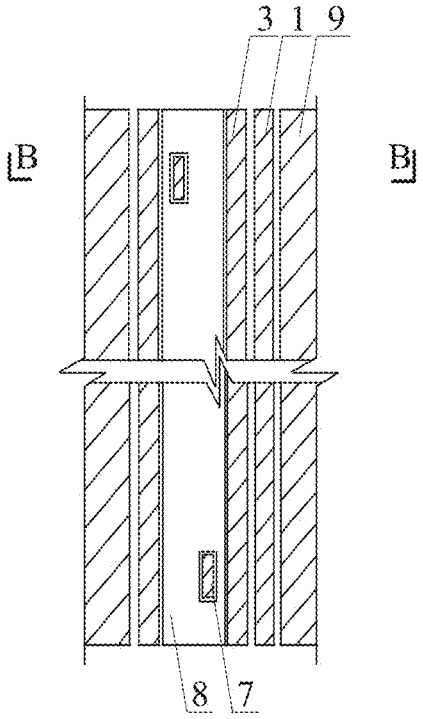
FIG. 5 is a C-C sectional view of an energy-consuming connecting device for a prefabricated assembled wall provided in an embodiment of the present invention.

By referring to FIG. 1 to FIG. 3, an embodiment of an energy-consuming connecting device for a prefabricated assembled wall provided by the embodiments of the present invention comprises a wrapping steel plate 1, a viscoelastic material 2, a grooved steel plate 3, a first fixing plate 4, a second fixing plate 5, a spring 6, a plate-shaped dowel 7 and an H-shaped steel column 8.

In the present embodiment, the wrapping steel plate 1 and the second fixing plate 5 are fixedly connected with the wall 9 lengthwise, wherein the wrapping steel plate 1 and the wall 9 have a small gap and do not contact with each other to avoid forming rigid connection. The viscoelastic material 2 is bonded to the inner walls of the wrapping steel plate 1 and the second fixing plate 5. Both sides of the grooved steel plate 3 are bonded with the viscoelastic material 2. When the steel plates are staggered mutually, the viscoelastic material can be cut to achieve the energy consumption effect. One end of the first fixing plate 4 is fixedly connected with the wall 9, and the other end is fixedly connected with the H-shaped steel column 8; and the fixing plate 4 is not a full-length plate, but a segmented plate to save steel. The second fixing plate 5 is connected with a short edge of the grooved steel plate 3 through the viscoelastic material 2, and is fixedly connected with the wall 9 lengthwise, thereby adding the cut part and enhancing the energy consumption effect of the device.

A certain gap is reserved among both sides of the grooved steel plate 3, the wall 9 and the wrapping steel plate 1 to facilitate displacement and cutting of the viscoelastic material to consume energy; one clamping groove is formed in alignment with the plate-shaped dowel 7; and the area of the clamping groove shall be slightly larger than the cross-sectional area of the plate-shaped dowel. Clamping grooves are formed on the H-shaped steel column 8 at the plate-shaped dowel 7, wherein the positions of the clamping grooves on a flange of a single side are mutually staggered, and the clamping grooves on flanges of both sides are symmetrically arranged. Similarly, the area of the clamping grooves shall be slightly larger than the cross-sectional area of the plate-shaped dowel. The plate-shaped dowel 7 is connected with the spring 6 and the spring 6 is fixed with the H-shaped steel column 8. When the H-shaped steel column 8 is inserted between two grooved steel plates 3, both sides of the plate-shaped dowel 7 are respectively clamped into the grooved steel plates 3 and the clamping grooves formed on the H-shaped steel column 8, thereby mitigating the vertical dislocation between the walls. Two flanges of the H-shaped steel column 8 are clamped into the grooved steel plate 3 to ensure more firmness. The viscoelastic material 2 can be selected from rubber which shall have enough strength and toughness. The flange thickness of the H-shaped steel column 8 shall satisfy the depth requirement of the clamping grooves at the flanges to avoid insufficient strength of the H-shaped steel column 8 after grooving.

In the energy-consuming connecting device for the prefabricated assembled wall in the present invention, the viscoelastic material can weaken the cold and hot bridge effect while providing energy consumption, which is beneficial to building thermal insulation. Meanwhile, the energy-consuming connecting device for the prefabricated assembled wall can be connected with the prefabricated wall in advance, which can be carried out at the same time as the wall is inserted during construction, thereby effectively increasing the construction efficiency. To ensure firmer connection, the clamping groove devices are designed so that the wall is connected firmly and reliably while generating displacement and consuming energy. The first fixing plate adopts a multi-segment form to replace full-length arrangement to save the steel. The energy-consuming connecting device for the prefabricated assembled wall has reasonable design, simple structure, and convenient production and installation. Because the assembled building is affected by the load vibration at any time, the application of the energy-consuming connecting device for the prefabricated assembled wall in the problem of vibration energy consumption of the assembled wall is more important.

It should be noted in design of the present invention that: firstly, the viscoelastic material 2 is firmly bonded to the wrapping steel plate 1, the second fixing plate 5 and the grooved steel plate 3, so as to ensure sufficient shear displacement. Secondly, the plate-shaped dowel 7 shall have greater strength and stiffness to avoid shear damage and deformation, and meanwhile, the depth of the clamping grooves 3 inserted into the grooved steel plate 3 shall be moderate to avoid slide-out. Thirdly, it should be noted that the wrapping steel plate 1 and the wall shall not contact with each other and shall have a certain displacement to satisfy relative displacement requirements of shear energy consumption.

The above embodiments of the present invention are not intended to limit the protection scope of the present invention, and the embodiments of the present invention are not limited thereto. According to the above content of the present invention and in accordance with ordinary technical knowledge and frequently-used means in the art, other various modifications, replacements or alterations made to the above structure of the present invention without departing from the basic technical idea of the present invention shall fall within the protection scope of the present invention.

The invention claimed is:

1. An energy-consuming connecting device for a prefabricated assembled wall, which is of a symmetrical structure and mainly composed of a wrapping steel plate, a viscoelastic material, a grooved steel plate, a first fixing plate, a second fixing plate, a spring, a plate-shaped dowel and an H-shaped steel column;

the wrapping steel plate is of a "J"-like structure; the top of a long edge of the wrapping steel plate is fixedly connected with one side of a wall, and a gap exists between a short edge and an other side of the wall; the wrapping steel plate and the wall are fixedly connected lengthwise;

the viscoelastic material is bonded to an inner wall of the wrapping steel plate and an inner wall of the second fixing plate;

a long edge of the grooved steel plate is bonded with the viscoelastic material, and two short edges of the grooved steel plate respectively have gaps from the wall and an inner wall of the short edge of the wrapping steel plate; a clamping groove is formed on the grooved steel plate in alignment with the plate-shaped dowel;

one end of the first fixing plate is fixedly connected with the wall, and the other end is fixedly connected with the H-shaped steel column; the first fixing plate is not a full-length plate, but a segmented plate;

one end of the second fixing plate is fixed on the wall, and the other end is opposite to the short edge of the wrapping steel plate; the second fixing plate is connected with a short edge of the grooved steel plate through the viscoelastic material, and is fixedly connected with the wall lengthwise;

clamping grooves are formed on the H-shaped steel column at the plate-shaped dowel, wherein the positions of the clamping grooves on a flange of a single side are mutually staggered, and the clamping grooves on flanges of both sides are symmetrically arranged; two flanges of the H-shaped steel column are clamped into the grooved steel plate;

the plate-shaped dowel is connected with the spring and the spring is fixed with the H-shaped steel column, wherein both sides of the plate-shaped dowel are respectively clamped into the grooved steel plate and the clamping grooves formed on the H-shaped steel column.

2. The energy-consuming connecting device for the prefabricated assembled wall according to claim 1, wherein the wrapping steel plate, the viscoelastic material, the grooved steel plate and the second fixing plate are prefabricated in advance with one side of the wall, and the first fixing plate and the H-shaped steel column are prefabricated in advance with the other side of the wall.

3. The energy-consuming connecting device for the prefabricated assembled wall according to claim 1, wherein the viscoelastic material is selected from rubber.

* * * * *